United States Patent [19]

Kinseley et al.

[11] Patent Number: 4,800,904

[45] Date of Patent: Jan. 31, 1989

[54] ARTICLE FOR REMOVING NAIL POLISH FROM A NAIL

[75] Inventors: Peter B. Kinseley, Weston; Stuart R. Kipperman, Easton; John A. Russo, Westport, all of Conn.

[73] Assignee: Chesebrough-Pond's Inc., Greenwich, Conn.

[21] Appl. No.: 3,356

[22] Filed: Jan. 14, 1987

[51] Int. Cl.[4] ..... A45D 29/18

[52] U.S. Cl. ..... 132/73.5; 132/73; 401/132; 206/812

[58] Field of Search ..... 132/73, 73.5, 74.5, 132/75, 88.7; 604/289, 292, 293, 306; 401/132, 7; 206/812, 210, 438

[56] References Cited

U.S. PATENT DOCUMENTS

| | | | |
|---|---|---|---|
| 2,980,940 | 4/1961 | Crowe | 15/104.94 |
| 3,124,825 | 3/1964 | Iovenko | 15/104.93 |
| 3,179,327 | 4/1965 | Burton et al. | 206/620 |
| 3,369,553 | 2/1963 | Keesee | 132/73.5 |
| 3,485,349 | 12/1969 | Chaney, Jr. | 206/812 |
| 4,282,891 | 8/1981 | Duceppe | 132/73.5 |
| 4,440,181 | 4/1984 | Scherer | 132/73.5 |
| 4,466,452 | 8/1984 | Ferrari | 132/75 |
| 4,474,195 | 10/1984 | Warner | 132/73 |
| 4,530,726 | 7/1985 | Montiel | 134/6 |

FOREIGN PATENT DOCUMENTS

| | | | |
|---|---|---|---|
| 0417187 | 10/1934 | United Kingdom | 604/292 |

*Primary Examiner*—Gene Mancene
*Assistant Examiner*—Adriene J. Lepiane
*Attorney, Agent, or Firm*—Melvin H. Kurtz

[57] ABSTRACT

An article for removing nail polish from a nail is described which comprises a sealed envelope having rupturable means along and adjacent to at least one edge thereof to allow for entry of a nail containing nail polish into the interior of the envelope, and an absorbent material, bonded to the inner surfaces of the envelope, which is impregnated with a nail polish remover.

4 Claims, 1 Drawing Sheet

ARTICLE FOR REMOVING NAIL POLISH FROM A NAIL

BACKGROUND OF THE PRESENT INVENTION

1. Field of the Present Invention

The present invention relates to an article, in the general form of an envelope, for removing nail polish from a nail, i.e., a fingernail or toenail.

2. Description of the Prior Art

Various means for removing nail polish, and the like, from a nail have been proposed.

Belgian Pat. No. 663,242 to Elizabeth Franz describes the impregnation of pieces of absorbent paper with a suitable mixture to remove nail polish, the papers being rectangular in shape and being kept in a plastic case with a fitted lid.

U.S. Pat. Nos. 3,686,701 and 3,729,569 to R. Charle et al. propose the use of microencapsulated solvents on a flexible support, such as a paper napkin, fabric, or porous synthetic material.

More recently, certain patents (U.S. Pat. Nos. 4,282,891, 4,440,181, 4,466,452, 4,474,195, and 4,530,726) have proposed cylindrical jar-like containers holding an absorbent filler or sponge-like material impregnated with a nail polish remover. Provision is made to allow for insertion of the fingernail into an opening, slit, or channel within the absorbent material to allow for rubbing of the fingernail against the liquid-soaked porous body to dissolve and rub off nail polish from the fingernail. Somewhat analogous to the use of a cylindrical container is U.S. Pat. No. 3,369,553 which shows a rigid, imperforate cup-shaped holder containing a disposable absorbent pad which is substantially co-extensive with the peripheral inner surface of the holder. The absorbent pad is saturated with polish-removing fluid and contains an open central bore into which the fingernail can be placed and rotated to effect removal of nail polish from the nail.

U.S. Pat. No. 3,014,579 is somewhat analogous to the foregoing since it shows a fluid impervious capsule or cover which forms an air-tight cocoon around applicators contained therein. The applicators each comprise a central core of sponge or sponge rubber saturated with a suitable nail polish cleaning fluid or thinner and a wad or pad of absorbent material such as cotton or the like, surrounding the core.

In U.S. Pat. No. 2,980,940 to A. M. Crowe, a device for the removal of nail polish is described which comprises a vapor-proof envelope containing a pad saturated with nail polish remover and a substantially U-shaped metallic holder or clip adapted to resiliently receive and grasp the pad. The envelope preferably is provided with lines of weakness, providing at least one tear strip, so that a portion of the envelope can be removed to expose the pad, with the remaining portions of the pad and the envelope being firmly held by the holder. The pad is saturated with nail polish remover. The device shown in this patent relies upon the act of exposing the pad so that the peripheral end portions of the pad protrude beyond the side of the holder and can be rubbed against the nail contained on each of the fingers of the hand simultaneously. The device is not designed or intended to be used in a manner in which the person would insert the finger into the envelope so that the nail would contact the polish-soaked porous material within the envelope.

Of more recent vintage than the patent just described is U.S. Pat. No. 3,124,825 to M. Iovenko. This patent illustrates a nail polish remover which consists of a flexible pouch heat-sealed at its free edges to form an envelope in which an applicator which has been saturated with a nail polish remover resides. When this nail polish remover is desired to be used, the person need only open one end of the package by tearing or cutting so that access to the applicator is provided. The applicator is then removed from the envelope and forced against the nails to scrub the nails with the polish remover. After use, the soiled applicator is preferably reinserted into the pouch and the entire package is discarded. Once again, the device shown in this patent does not contemplate the insertion of the nail into the interior of the envelope so as to contact a porous material bonded therein.

SUMMARY OF THE PRESENT INVENTION

The article for removing nail polish from a nail which is contemplated by the present invention comprises a sealed envelope having bonded therein an absorbent material which is impregnated with nail polish remover. The sealed envelope has a rupturable means along and adjacent to at least one edge thereof which allows for entry of a nail carrying nail polish into the interior of the envelope. When this is performed, the person can rub the nail carrying the nail polish against the impregnated absorbent material which is bonded to the inner surface of the envelope so that the polish remover effects removal of nail polish from the nail.

DESCRIPTION OF THE DRAWINGS

The present invention is more fully understood by the drawings which form a portion of the specification wherein.

DETAILED DESCRIPTION OF THE PRESENT INVENTION

Figure 1:
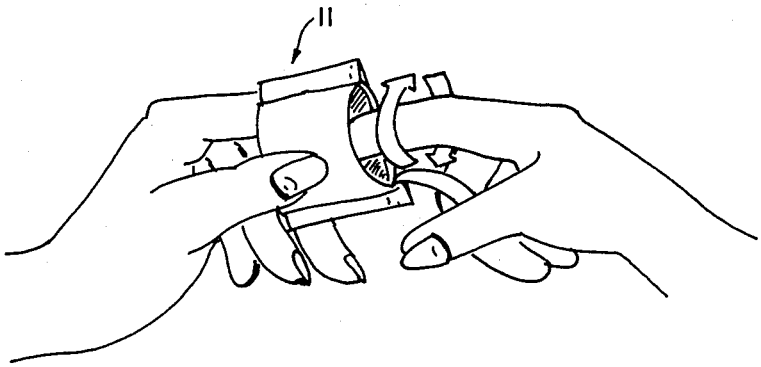
FIG. 1 is a perspective view showing how the present invention is utilized to remove nail polish from a nail.

FIG. 1 illustates the general manner in which the article of the present invention is used to remove nail polish from a nail, for example, from a fingernail. As illustrated in the figure, the article 11 of the present invention is held in one hand while a nail on the finger of the other hand is inserted into the interior of the article and rotated in an appropriate manner to bring the nail into contact with an absorbent material bonded to the inner surface of the article which is impregnated with nail polish remover to effect removal of the nail polish.

Figure 2:
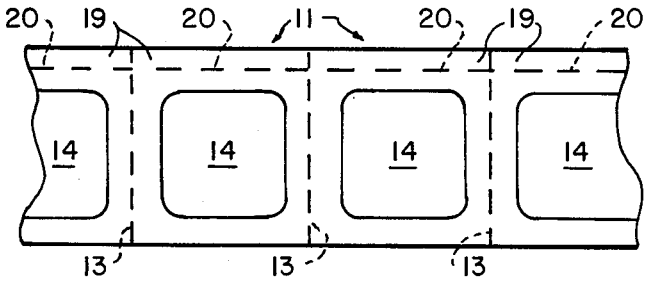
FIG. 2 is an overhead view of one of the envelopes of the present invention.

FIG. 2 illustrates a possible embodiment wherein a plurality of the articles are present with appropriate perforations 13 which allow for tearing of one of the articles from the strip formed by a plurality of such articles. The central area 14 is the area of the article and inner absorbent material which overlies the open area in which the nail of the person is adapted to be inserted.

Figure 3:
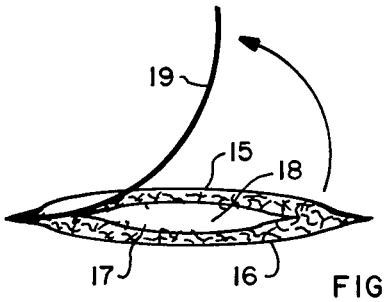
FIG. 3 is an endview showing the interior of the envelope after the envelope has been opened.

FIG. 3 shows the article in cross-sectional view. The article is of envelope-like construction comprising a front panel 15 and a rear panel 16 of suitable fluid impervious material, e.g., metal foil such as aluminum foil. Bonded to at least one of the inner surfaces of the fluid impervious materials 15 and 16 is an absorbent material 17 which is impregnated with nail polish remover so as to be capable of effecting the removal of nail polish from a nail. In a preferred embodiment the absorbent material 17 is bonded to the inner facing surfaces of elements 15 and 16. The central area 18 of the article consists of an opening into which the nail can be placed and rotated as shown in FIG. 1. This open area 18 generally corresponds to the area denoted by reference numeral 14 in FIG. 2. In order to prevent evaporation of the nail polish remover chemicals that impregnate the absorbent material 17, the article is sealed by end flap member 19 which can be torn from the remaining portions of the envelope article, as illustrated in FIG. 3, by means of perforations 20.

The foregoing illustrate certain embodiments of the present invention and are presented for illustrative purposes only. The scope of protection that this sought is set forth in the claims which follow.

We claim:

1. An article for removing nail polish from a nail which comprises:

(a) a sealed envelope sealed along three edges and having a rupturable sealed means along and adjacent to one edge thereof to allow for entry of a nail coated with nail polish into the interior of the envelope; and (b) an absorbent material, bonded to the inner surfaces of the envelope, which is impregnated with nail polish remover and which is adapted to come in contact with the nail that is coated with nail polish to remove the nail polish therefrom, when within the envelope.

2. An article as claimed in claim 1 wherein the absorbent material which is impregnated with nail polish is bonded to inner, facing surfaces of the envelope and has an opening therebetween designed to receive the nail.

3. An article as claimed in claim 2 wherein the envelope is formed of fluid impervious foil.

4. An article as claimed in claim 1 wherein the envelope is formed of fluid impervious foil.

* * * * *